United States Patent [19]

Renko

[11] 4,200,440

[45] Apr. 29, 1980

[54] FILTER CONSTRUCTION

[75] Inventor: Ronald J. Renko, Wellsville, N.Y.

[73] Assignee: The Air Preheater Company, Inc., Wellsville, N.Y.

[21] Appl. No.: 12,988

[22] Filed: Feb. 21, 1979

[51] Int. Cl.[2] ..... B03C 3/12; B03C 3/62

[52] U.S. Cl. ..... 55/131; 55/138; 55/146; 55/155; 55/523

[58] Field of Search ..... 55/124, 131, 136, 138, 55/146, 154–155, 523

[56] References Cited

U.S. PATENT DOCUMENTS

| | | | |
|---|---|---|---|
| 2,085,735 | 7/1937 | Brion et al. | 55/137 |
| 3,577,705 | 5/1971 | Sharlit | 55/131 X |
| 3,733,784 | 5/1973 | Anderson et al. | 55/138 X |
| 3,793,802 | 2/1974 | Hardt | 55/155 |
| 3,930,815 | 1/1976 | Masuda | 55/131 X |
| 3,945,813 | 3/1976 | Iinoya et al. | 55/124 X |

FOREIGN PATENT DOCUMENTS

| | | | |
|---|---|---|---|
| 821900 | 9/1969 | Canada | 55/131 |

*Primary Examiner*—Kathleen J. Prunner
*Attorney, Agent, or Firm*—Wayne H. Lang

[57] ABSTRACT

A filter arrangement that imposes an electric charge of "like" polarity upon particulate matter carried by a gas stream and upon a porous support for a filter whereby the particulate matter is repelled from the filter support but caused to collect loosely on the leading edge of the adjacent filter to form a loose bed of increasing thickness that enhances the effectiveness of the filter. The filter and the support therefor are both comprised of temperature resistant ceramic materials while a metallic coating on the surface of said ceramic support distributes the charge evenly to all portions of the filter support.

6 Claims, 3 Drawing Figures

FILTER CONSTRUCTION

BACKGROUND OF THE INVENTION

1. Field of the Invention

This invention relates to an electrostatically aided filter apparatus through which gaseous fluid carrying dust or other particulate matter is directed in order that it may retain the particulate matter while the clean gas is permitted to flow continuously therethrough.

2. Description of the Prior Art

According to U.S. Pat. No. 3,733,784, particulate matter approaching a filter means is subjected to an electric charge while a metallic support cage for a filter bag is subjected to a similar charge that causes the charged particles to be repulsed therefrom. A housing that surrounds the filter means is given an opposite charge (grounded) so that the charged particles are attracted thereto instead of collecting upon the filter itself. Therefore, some particulate matter collects upon the housing and other particulate matter is collected upon the surface of the filter.

As dust laden gas enters the filter housing, some of the charged particulate matter collects on the oppositely charged housing wall while other particulate matter collects on the filter itself. Inasmuch as the filter is supported on a mesh of widely spaced conductors that carry a charge similar to that originally given the particulate matter, all particulate matter should be repulsed therefrom. However, due to the fact that the wires of the wire cage supporting the bag filter are widely spaced, the strength of the electric field between said wires is low and there is practically no electrostatic repulsion of dust particles. Therefore the particles collect, compact, and then resist the passage of more fluid.

The present invention imparts to the particulate matter entering a filter apparatus a given electrostatic charge, but it does not give an opposite charge to the surrounding housing so the particulate matter is not attracted thereto. Instead, "like" charges are imparted to the particulate matter entering a filter housing and to a finely divided porous support for filter means therefor whereby all the particulate matter will collect loosely on the filter to provide a finely dispersed filter body that enhances further filtration. This is essentially true because all of the individual particles being collected on the filter have the same charge as the porous base and as each other, so collectively they comprise a loosely held particle mass.

SUMMARY OF THE INVENTION

An object of this invention is to provide a filter arrangement that is economical to manufacture, highly effective to operate, and requires a minimum of maintenance.

A further object of this invention is to provide a filter that is assisted by an electrostatic action. Specifically, particulate matter in a gas stream and a filter support are subjected to a "like" electric charge whereby an electrostatic charge of repulsion will preclude particulate matter from traversing the filter. Instead, said particulate matter will collect evenly as a porous cake adjacent the face of the filter to form a highly permeable filter that itself will enhance the overall filtering effectiveness of the apparatus.

A porous substrate, the filter, and a retainer therefore are all formed of ceramic material that is impervious to temperatures that would disintegrate the usual metallic filter members.

DESCRIPTION OF THE PREFERRED EMBODIMENT

Figure 1:
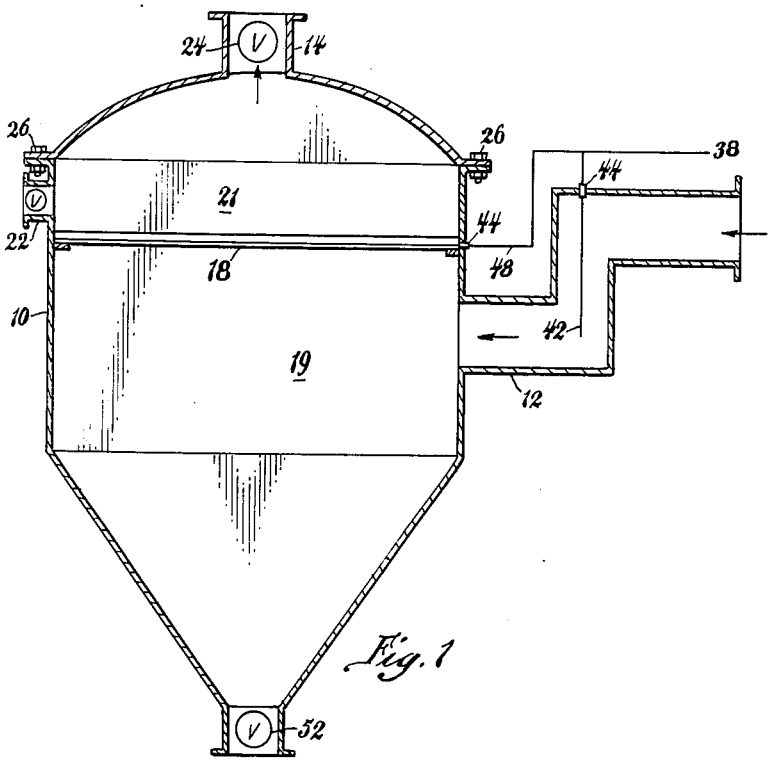
FIG. 1 of the drawing refers to a side elevation of a filter that utilizes the present invention.
Figure 2:
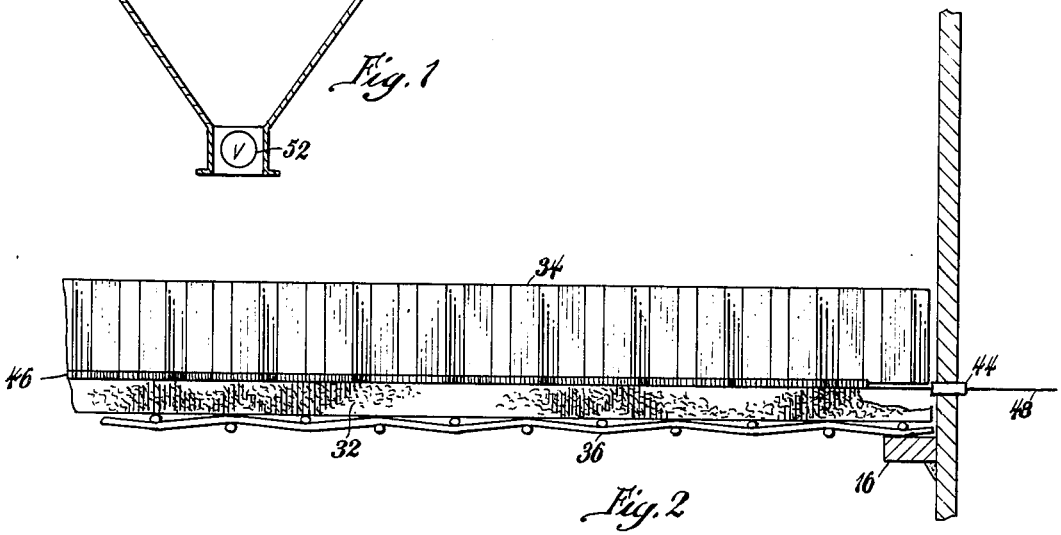
FIG. 2 is an enlarged cross-section of the filter in FIG. 1, partially broken away to show the essential features of the device, and FIG. 3 of the drawing is an exploded perspective view of the porous ceramic support showing its arrangement for peripheral support.
Figure 3:
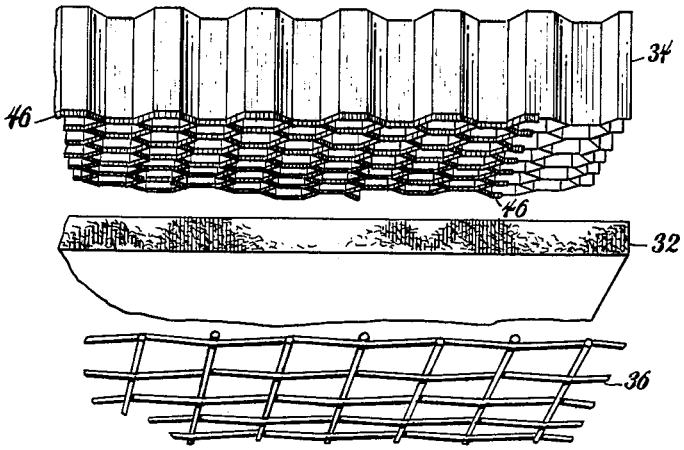

The apparatus according to this invention comprises a housing 10 having an inlet 12 for dust entrained gas and an outlet 14 for the exhaust of clean gas therefrom. The housing 10 encloses a filter compartment that is provided around the inner periphery thereof, intermediate the inlet and outlet ports, with an annular shelf 16 adapted to support the filter assembly 18 that separates the filter compartment into an inlet chamber 19 and an outlet chamber 21. The housing is also provided with a backward port 22 whereby pressurized fluid from a given source (not illustrated) may be caused to flow back through the filter assembly 18 to flush particulate matter from the surface thereof. The apparatus is provided with valve means 24 in the outlet duct 14 whereby said valve may be closed to permit back flow from port 22 to cause a reverse flow through filter 18.

The upper part of the housing is adapted to be removed for inspection or repair of the filter assembly 18 by loosening hold-down bolts 26, while the lower part of the housing includes a hopper having a suitable valving means 52 for the removal of particulate matter that has been flushed from the filter.

The filter assembly 18 comprises essentially a mass of ceramic fibers compressed into a semi-rigid sheet form 32. The fibers are preferably positioned in a random array whereby they are free to subject all particulate matter being directed therethrough to a filtering action.

The fibers of the filter 32 are adapted to abut a porous ceramic substrate or support 34 at one side thereof to provide rigidity without adversely affecting the flow of fluid therethrough. A screen type grid 36 of elongate ceramic fibers such as glass or ceramic holds the filter 32 against backing 34 so that the entire filter assembly may be comprised of temperature resistant ceramic materials.

To enhance the separation of particulate matter from the carrier gas stream, means is also provided for utilizing the phenomenon of electrostatic repulsion. Accordingly, a source of high voltage 38 is connected to a discharge electrode 42 that is connected to a discharge electrode 42 that is supported by an insulator 44 in the inlet for dust laden gas. A charge of the same polarity is placed on a metallic coating 46 that is applied to the face of the porous ceramic support 34.

The metallic coating 46 is applied to the central part of the ceramic substrate 34 only whereby the central portion thereof will be insulated from the surrounding housing 10 by a non-conducting ceramic periphery. The manner by which the coating 46 is applied to substrate 34 is not held critical, however a preferred method of application would entail the application of a metallic brazing powder to the substrate 34 and then heating it to a suitable melting temperature whereby the brazing powder will melt and coat the substrate to which it has been applied.

The coating 46 is then connected to a source of high voltage 38 being transmitted by conductor 48 through insulator 44 whereby "like" charges are being placed on particulate matter entrained in the gas stream by discharge electrode 42 and upon a finely divided coating 46 through which the gas stream is being directed.

In operation, dust laden gas is admitted through inlet 12 and flows upward where it is naturally distributed over the filter assembly 18. When traversing inlet 12, the entire gas stream passes discharge electrode 42 where the dust particles therein are given an electric charge. Simultaneously, the same charge is directed into the filter housing to the filter assembly where a "like" charge is imposed upon the metallic coating 46. Inasmuch as the same charge is placed upon the dust particles and the metallic coating 46, the dust is repelled therefrom but the dust-free gas is free to flow unimpeded through the filter 32 and support 34 to outlet duct 14.

Dust particles collect loosely on the face of filter element 32 and inasmuch as all dust particles are of the same polarity, they too repel one another, so instead of packing they collect loosely in a spaced apart relation upon the leading edge of the filter 32.

As particles break away from the filter 32 and fall into the hopper, they may be periodically removed therefrom through valve 52.

What is claimed is:

1. Apparatus for filtering particulate matter from a gas stream including a housing enclosing a filter compartment and having an inlet port for gas to be filtered and an outlet port for the exhaust of clean gas therefrom, filter means extending across said housing intermediate the inlet and outlet ports adapted to intercept the particulate matter and divide said filter compartment into inlet and outlet chambers, a porous ceramic support lying in said outlet chamber laterally adjacent the filter means, a metallic surface on said ceramic support, a discharge electrode adjacent said inlet adapted to subject particulate matter traversing the inlet to electrostatic discharge from said electrode, and means for applying a similar electric charge to the metallic surface and to said discharge electrode whereby the particulate matter is repulsed from the porous filter support while clean gas is permitted to flow therethrough.

2. Apparatus for filtering particulate matter from a gas stream as defined in claim 1 wherein the filter means comprises a layer of randomly disposed ceramic fibers that intercept the particulate matter.

3. Apparatus for filtering particulate matter from a gas stream as defined in claim 2 including a wire support grid lying in the inlet chamber adjacent the layer of ceramic fibers, said support grid adapted to hold the filter layer against the ceramic support to form a unitary assembly therewith.

4. Apparatus for filtering particulate matter from a gas stream as defined in claim 3 wherein the metallic surface forms an interface between the ceramic support and the filter means.

5. Apparatus for filtering particulate matter from a gas stream as defined in claim 4 including insulating means that isolates the metallic surface from the housing.

6. Apparatus for filtering particulate matter as defined in claim 5 wherein the insulating means comprises the periphery of the ceramic support.

* * * * *